US005812166A

United States Patent [19]

Yamazaki

[11] Patent Number: 5,812,166

[45] Date of Patent: Sep. 22, 1998

[54] INK CARTRIDGE PACKAGE, ASSEMBLY AND PACKING METHOD THEREOF, AND INK CARTRIDGE PACKED USING SAME

[75] Inventor: Tsutomu Yamazaki, Suwa, Japan

[73] Assignee: Seiko Epson Corporation, Tokyo, Japan

[21] Appl. No.: 701,298

[22] Filed: Aug. 21, 1996

[30] Foreign Application Priority Data

Aug. 23, 1995 [JP] Japan ..... 7-215085

[51] Int. Cl.[6] ..... B41J 2/175

[52] U.S. Cl. ..... 347/87

[58] Field of Search ..... 347/85, 86, 87; 53/405

[56] References Cited

U.S. PATENT DOCUMENTS

| | | | |
|---|---|---|---|
| 4,936,460 | 6/1990 | Meyer | 53/405 |
| 5,244,087 | 9/1993 | Hikake et al. | 347/87 |
| 5,262,802 | 11/1993 | Karita et al. . | |

FOREIGN PATENT DOCUMENTS

| | | | |
|---|---|---|---|
| 0 389 621 | 10/1990 | European Pat. Off. . | |
| 0 423 374 | 4/1991 | European Pat. Off. . | |
| 559 206 A2 | 9/1993 | European Pat. Off. . | |
| 661 160 A2 | 7/1995 | European Pat. Off. . | |
| 62-19460 | 1/1987 | Japan . | |
| 3-101944 | 4/1991 | Japan . | |
| 3-101945 | 4/1991 | Japan . | |
| 3-176156 | 7/1991 | Japan . | |
| 3-234659 | 10/1991 | Japan . | |
| 4-73158 | 3/1992 | Japan . | |
| 5-270002 | 10/1993 | Japan | 347/85 |
| 5-305791 | 11/1993 | Japan . | |
| 6-212062 | 8/1994 | Japan . | |
| 6-328712 | 11/1994 | Japan . | |
| 8-112915 | 5/1996 | Japan . | |

*Primary Examiner*—N. Le
*Assistant Examiner*—Judy Nguyen
*Attorney, Agent, or Firm*—Eric B. Janofsky

[57] ABSTRACT

Techniques for packaging inkjet style ink cartridges which prevent ink seepage without dedicated nozzle pressing mechanisms, nozzle sealants, or adhesives. Specifically, the ink cartridge is circumscribed by a flexible, multifaced cartridge holder which is then placed in an aluminum bag and vacuum packed. Integral, ink impermeable nozzle compressing and cartridge terminal coverage components are disposed on the inner periphery of the cartridge holder and engage the respective cartridge ink ejection and terminal areas when the cartridge holder is folded around the ink cartridge. Vacuum packing forces the outer aluminum bag to constrict and compress the cartridge holder, thereby securing the cartridge and sealing off the ejection area through compression of the aforementioned compressing and coverage surfaces. As a result, the ink cartridge can be packaged without the use of any adhesive materials, and the sealing performance can be significantly improved using a simple packing method.

14 Claims, 9 Drawing Sheets

INK CARTRIDGE PACKAGE, ASSEMBLY AND PACKING METHOD THEREOF, AND INK CARTRIDGE PACKED USING SAME

BACKGROUND OF THE INVENTION

1. Field of the Invention

The invention generally relates to replaceable cartridge packing techniques, and is particularly concerned with low-cost, easily manufactured ink cartridge packaging assemblies including a seal component to prevent undesirable ink leakage.

2. Description of the Related Art

One of the messier workplace tasks brought about by the widespread introduction of personal computers and their peripheral devices into the home and office has been replacing printer consumables, such as laser printer toner or ink ribbons. All too often, ink, toner or similar recording agents become dislodged or seep from their cartridge housing during shipping or transport from the factory, and wind up getting on hands, clothes, furniture and printer casing instead of on the recording media they are intended for. Ink jet printers in particular are renowned for their low-cost and high-quality output, but their liquid ink reservoirs are especially prone to premature leakage. Certainly, it is no fun to open an inkjet cartridge package in order to finish that memo, report or presentation, only to discover an already stained cartridge oozing ink on everything, including your fingers.

In response, as disclosed in unexamined Japanese patent application No. H3-234659 and counterpart U.S. Pat. No. 5,262,802 to Karita, et al., manufacturers have introduced, as part of the replacement cartridge packing materials or even on the cartridge itself, a pressurizing component for pressing a sealing component against the ink ejection area of the ink cartridge when stored or not used. Furthermore, according to this conventional approach, a sealing component possessing an adhesive is typically directly adhered to the ink ejection area to close it off and prevent seepage.

However, it quickly became necessary to use a dedicated pressurizing component to cover the ink ejection area from outside the sealing component, in order to achieve and maintain a tight seal. This is because even when the sealing component is positioned over and contacts the ink ejection area, absent external compressive force, the ink may still seep out from the junction through capillary phenomenon. Therefore, manufacturers have resorted to at least a two-step packaging process in which the ink cartridge ejection area is first sealed by an external sealing member, and then, the cartridge is positioned such that a dedicated pressurizing component positively engages the sealing member and holds it in position while packaged.

Further, according to this technique, because the adhesive surface of the sealing component is pressed against the ink ejection area, adhesive residue may be left on the ink ejection area itself or adhere to the area immediately surrounding the ink ejection area, particularly when the ink cartridge remains packaged for an extended period of time. This residue can, in turn, interfere with normal printing operations and degrade output quality, and could even block or clog the ejection area to the point that the cartridge becomes unusable.

OBJECTS OF THE INVENTION

It is, therefore, an object of the present invention to maintain and even enhance ink ejector area sealing performance without using an adhesive that could leave undesirable deposits when the sealing member is removed. It is yet a further object of the invention to improve the sealing performance without the need for any dedicated pressurizing component as part of the cartridge packaging,

SUMMARY OF THE INVENTION

In accordance with these and related objects, the present invention involves including a nozzle pressing component made of a flexible material in the packaging material, and is used to engage and cover the ink ejection area of an ink cartridge. Also, a complimentary ink cartridge holder for holding the ink cartridge such that its ejection area is positioned in front of the nozzle pressing component of the package is included as well. Moreover, a circumscribing bag housing that houses the ink cartridge held by the holder and covered by the nozzle pressing component is utilized to maintain the packaged positions of the ink cartridge, nozzle pressing component and cartridge holder. Preferably, this bag housing will be oriented to cover both the loaded ink cartridge holder and nozzle pressing component and then sealed under reduced pressure to maintain a stable package assembly.

According to the preferred embodiments of the invention, an impermeable, compressible layer comprising a plastic film is fastened to a portion of the nozzle pressing component that immediately contacts the ink cartridge ejection area. Also, the ink cartridge holder is constructed using a low-cost cushioning material such as water-resistant corrugated cardboard. Likewise, the bag housing preferably consists of a shaped aluminum pack large enough to accept a load cartridge housing while maintaining a supportive, form-fitting shape when depressurized.

Also, preferably, the ink cartridge package assembly additionally includes an integral terminal pressing component for covering and protecting a surface electrical terminal area present on the ink cartridge. It is possible to form this terminal pressing component and the aforementioned nozzle pressing component as a single unit.

According to the preferred embodiments, the ink cartridge is placed inside the aluminum pack while the ejection area of the ink cartridge is touching the flexible nozzle pressing component, and then the aluminum pack is sealed under reduced pressure. During this process, the aluminum pack contracts due to the difference in the pressures inside and outside the aluminum pack, and the nozzle pressing component is pressed against the aluminum pack. As a result, intimate contact between the nozzle pressing component and the ejection area of the ink cartridge is made without any adhesives. In other words, no adhesive is required for sealing the nozzle, thus eliminating the risk of an adhesive entering or sticking to the ink ejection area. As a result, excellent, adhesive-free ink cartridges can be supplied to users.

Furthermore, by sealing the aluminum pack under reduced pressure, the ejection area is automatically sealed, and the ink ejection area can be securely sealed without the use of a dedicated pressurizing component for covering the ink ejection area from outside the sealing component, eliminating the need for a dedicated pressurizing component and thus reducing the cost of the package itself.

Moreover, the ink cartridge according to the preferred embodiment may include a terminal pressing component for covering an exposed ink cartridge terminal area when packaged. During the reduced-pressure sealing of the pack, the ejection area is brought into intimate contact with the nozzle pressing component and, at the same time, the terminal area also is brought into intimate contact with the terminal pressing component and is thus protected. When there are two locations that must be protected, such as the ink cartridge nozzle and terminal areas, both can be sealed using a single sealing component, resulting in cost reduction. However, different surfaces of the unified sealing component may be utilized to prevent terminal area ink contamination even if the nozzle is not sealed completely and seepage occurs.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

A representative ink cartridge according to the first preferred embodiment of the invention will be explained below with references to FIGS. 7 and 8.

Figure 7:
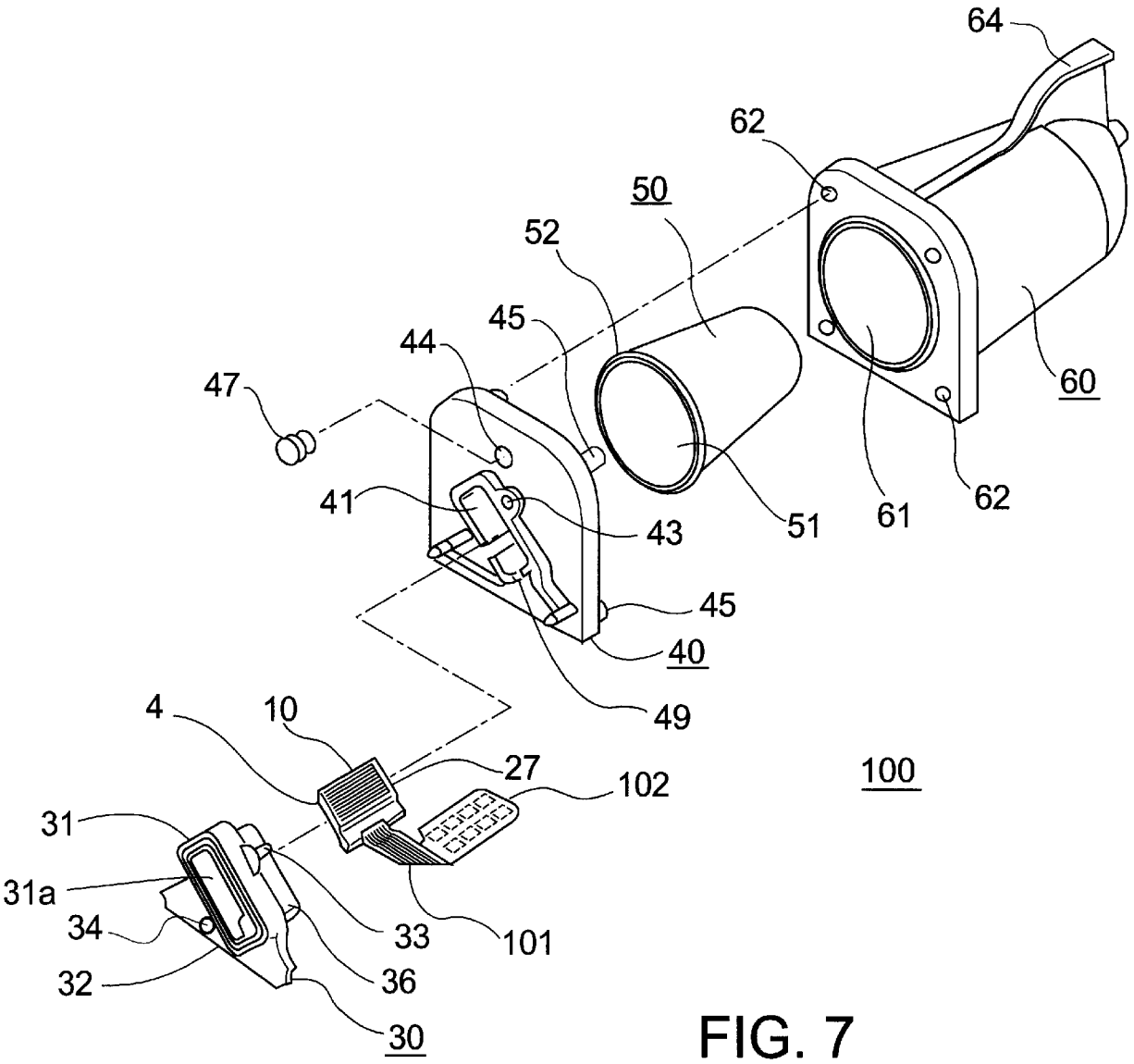
FIG. 7 is an exploded perspective view of a representative ink cartridge according to the first preferred embodiment.

FIG. 7 is an exploded perspective view showing the configuration of a representative ink cartridge. Likewise, FIG. 8 is a cross-section of the ink jet head connection unit (area comprising ink jet head 10 and cases 30 and 40) forming part of the front end of the ink cartridge.

Ink cartridge 100 generally comprises an ink jet head connection unit which consists of first case component 40 (hereinafter referred to as "head case"), second case component 30 (hereinafter referred to as "nozzle case 30"), and ink jet head 10; and an ink supply area which consists of ink sack 50 and ink case 60.

Nozzle case 30 is preferably made of a resin such as AS, ABS, or PSF (polysulfone). Nozzle plate 31 equipped with opening 31*a,* through which nozzles 4 appears when ink jet head 10 is mounted, is provided in the center of nozzle case 30. Ink-stop groove 32 is provided around the nozzle plate 31. This ink-stop groove 32 is designed to use surface tension to retain the ink that is ejected from the nozzle during a priming operation. A priming operation (involves pressing of ink sack 50 from the outside in order to eject viscous ink or air bubbles) is used when the nozzle is clogged or when air bubbles inside the ink path cause an ejection failure. The ejected ink is retained inside the groove through surface tension. The user performs a priming operation while observing the amount of the ejected ink. That is, the internal area of the groove is preset to enable an appropriate priming operation when the ejected ink fills the groove.

Protruding wall 36 for forming the adhesive groove (to be described below) is formed on the external perimeter of the opening on the back of nozzle case 30. Two pins 33 (only the top one shown here) for connecting the head case are formed on the back of nozzle case 30. Adhesive injection opening 34 is provided on the bottom front of nozzle case 30, and this adhesive injection opening 34 is connected to the adhesive groove described below.

Head case 40 is preferably made of a transparent material such as PSF (polysulfone), PC (polycarbonate) or ABS. Linking hole 43 is formed on part of head case 40 that faces nozzle case 30. Upper pin 33 of nozzle case 30 is pressure-fit into this linking hole 43, linking nozzle case 30 to head case 40. Opening 41, into which protruding wall 36 of the nozzle case is inserted, is formed in the approximate center of head case 40, and opening 42 (shown in FIG. 8) which has substantially the same shape as opening 31*a* of the nozzle case is provided in the center of opening 41. This opening 42 houses the side of ink lead-in opening 27 of ink jet head 10.

Nozzle 4 is formed on one end of ink jet head 10, and ink lead-in opening 27 is formed on the opposing end. Multiple pressure-generating elements are preferably positioned in a line inside ink jet head 10. In this embodiment, each of the pressure-generating elements consists of electrostatic actuator 80 formed by opposing diaphragm 5 and individual electrode 21, as shown in FIG. 8. When this electrostatic actuator 80 is charged, the resulting electrostatic force distorts diaphragm 5 toward individual electrode 21. As a result, the pressure inside ejection chamber 6 declines, drawing ink from reservoir 8 into ejection chamber 6. Subsequently, when charging is stopped, abruptly discharging the charge accumulated in electrostatic actuator 80, the elastic force of the diaphragm restores diaphragm 5 to its original shape. During this process, the pressure inside ejection chamber 6 rises abruptly, ejecting ink droplets 104 from nozzle 4.

Turning back to FIG. 7, Head FPC (flexible print circuit) 101 for sending signals to the pressure-generating elements of the ink jet head is inserted into groove 49 of head case 40, terminal area 102 of FPC is fastened to the bottom surface of ink case 60. When an ink cartridge is mounted on the carriage (not shown herein), the printing terminal provided in the carriage and terminal 102 of FPC become electrically connected.

Nozzle case 30 is connected to cover head case 40 in which ink jet head 10 is thus housed. A pair of claws 37 for clamping the ink jet head is provided inside protruding wall 36 of nozzle case 30, (See FIG. 8) and these claws press against ink jet head 10 to the bottom of opening 42 of head case 40 during case connection. As a result, the surface of ink jet head 10 on the side of ink lead-in opening 27 makes a tight contact or frictional fit with the bottom of the opening of head case 40. Further, ink jet head 10 is supported inside the case with ink lead-in opening 27 of ink jet head 10 connected to the ink supply port (not shown in FIG. 7) provided on the bottom of the opening of head case 40. Claws 37 also possess a function of positioning ink jet head 10 relative to the case.

Figure 8:
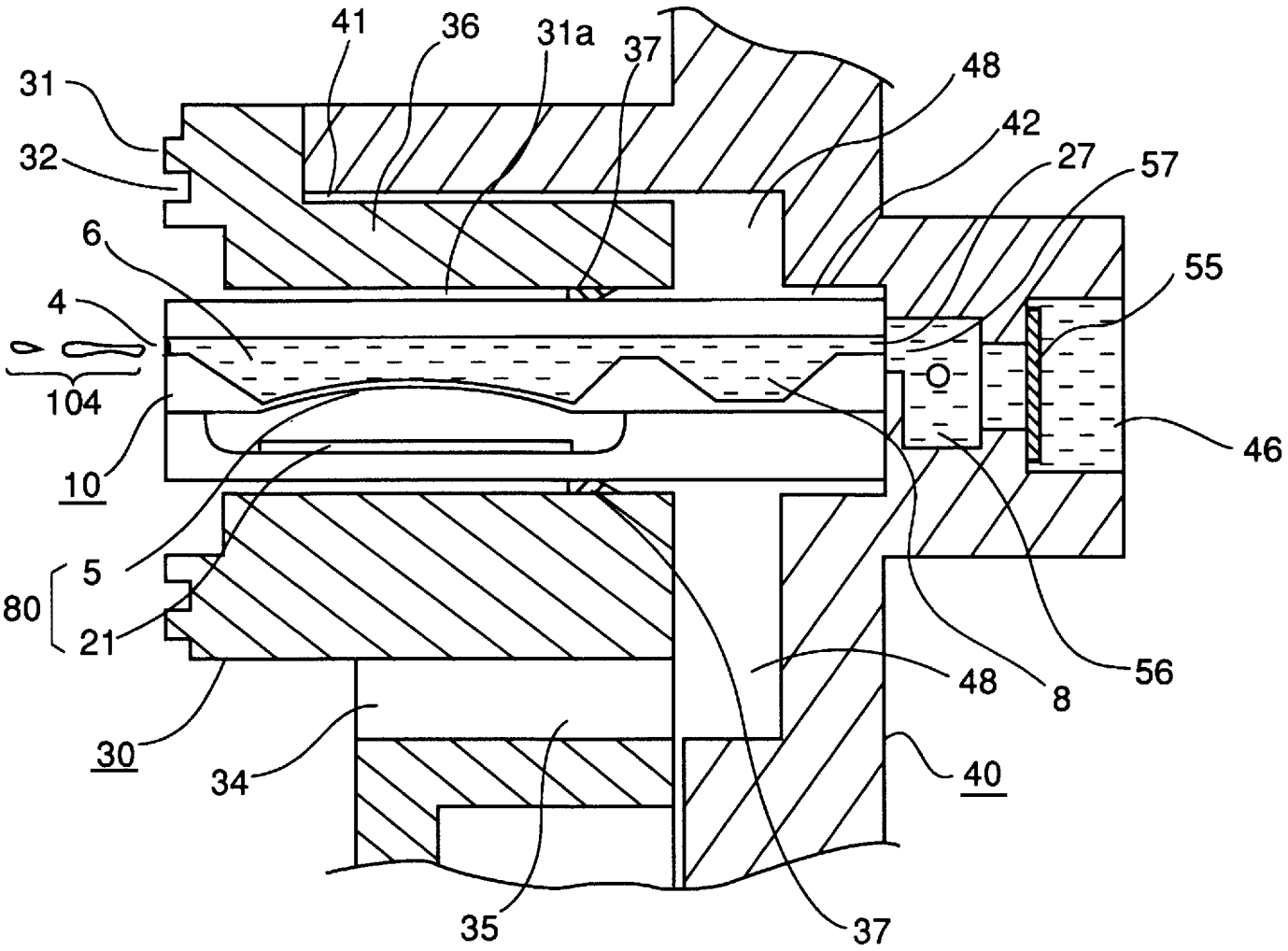
FIG. 8 is partial cross-sectional view of the ink cartridge of FIG. 7 illustrating the ink jet head connection unit.

As shown in FIG. 8, opening 41 of the head case and protruding wall 36 of the nozzle case form a space (adhesive groove 48) around the entire outside perimeter of the ink jet head 10 near ink lead-in opening 27 of ink jet head 10 inside the connected case.

Nozzle case 30 is provided with adhesive injection opening 34 and injection tube 35, and a dispenser provided with a hypodermic needle, for example, is used to inject an adhesive from injection opening 34 through injection tube 35 into adhesive groove 48. In this way, the area around lead-in opening 27 of ink jet head 10 is sealed by the adhesive and ink jet head 10 is fastened to the case.

The ink jet head connection unit is thus joined, resulting in complete connection from the ink supply area to the nozzle. In other words, the ink supplied from ink supply tube 47 formed on the back of head case 40 is supplied to lead-in opening 27 of ink jet head 10, and is ejected as ink droplets 104 from nozzle 4 when the pressure-generating means inside the head is activated.

An ink filling port 44 is provided on the top front of head case 40. Ink filling port 44 is plugged by press-fit plug 47 at all times other than when ink is being loaded into the ink cartridge. To prevent foreign matter from being introduced to the ink when plug 47 is inserted, plug 47 is made of a nylon material, for example. However, a soft resin such as polyimide or a metal ball can also be used as will become apparent to those ordinarily skilled in the art. Ink supply tube 46 is formed on the back of the head case, and filter 55 is heat-welded to its opening. Additionally, multiple pins 45 for connecting the head case to ink case 60 are provided on the back of the head case.

Ink sack 50 is preferably made of butyl rubber, for example, and its tip consists of circular opening 51 as shown in the figure, and packing 52 is provided around opening 51. This packing 52 forms a sealing structure by being clamped between head case 40 and ink case 60.

To prevent the ink from leaking from nozzle 4 of an ink cartridge during a standby state in which no printing is taking place or when the ink cartridge is removed from the printer and left idle, it is necessary to constantly supply (negative) pressure for returning the ink from ink jet head 10 to the ink path formed inside the ink cartridge. In this embodiment, the negative pressure is obtained by the spring characteristic (shape restoration characteristic) of ink sack 50.

Like head case 40, ink case 60 is preferably made of a transparent material such as PSF (polysulfone), PC (polycarbonate), and ABS. Opening 61 is formed on the side of ink case 60 that faces head case 40, which houses ink sack 50. Linkage hole 62 is also formed, and pin 45 of the head case is pressure-fitted into this hole, physically engaging and linking together head case 40 and ink case 60. Protrusion 63 for positioning ink cartridge 100 during its mounting onto the carriage is provided on the back of ink case 60. As will be explained below, this protrusion 63 also prevents ink cartridge 100 from slipping off the packing when ink cartridge 100 is being placed therein. Handle 64 is provided on the upper back of ink case 60, which makes it easier to hold the ink cartridge 100 during carriage mounting operations.

When the ink cartridge thus configured is left idle for an extended period of time, the water inside the ink near nozzle 4 evaporates, increasing the viscosity of the ink. Also, if the ink cartridge is dropped or is subjected to a shock, air bubbles are sucked into the cartridge through the nozzle. An ink cartridge in such a state can no longer eject the ink correctly.

Furthermore, during the transportation of the ink cartridge, a shock may cause the ink to leak through the nozzle, contaminating the ink cartridge itself or its vicinity. Therefore, before the cartridge is shipped, it is necessary to seal the nozzle to ensure such problems will not occur, and yet to allow consumers to easily open the package. The ink cartridge package according to the presently preferred embodiment of the invention is explained below with references to FIGS. 1 through 6.

Figure 1:
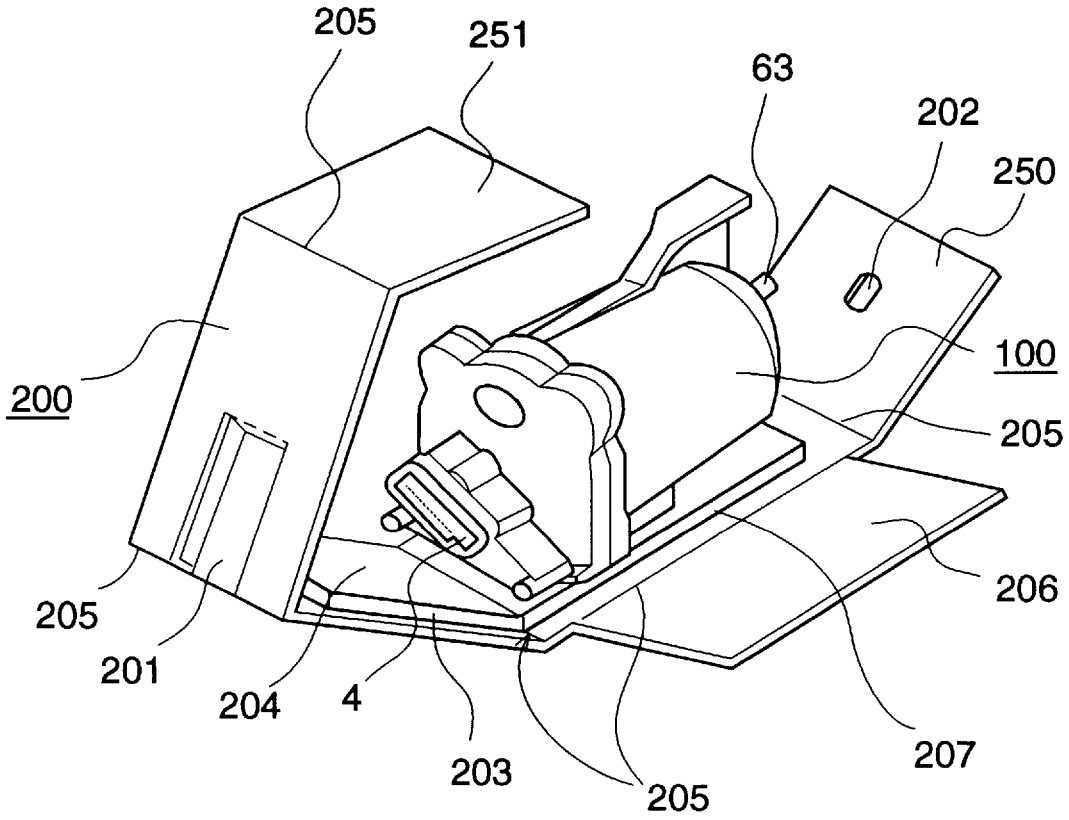
FIG. 1 is a perspective view of a partially disassembled internal case of the cartridge package according to the first preferred embodiment of the present invention including an ink cartridge.

FIG. 1 is a perspective view showing the representative ink cartridge 100 and the internal case for packing this ink cartridge in a partially opened state.

The cartridge holder 200 used to hold and secure the ink cartridge during shipping consists of a cushioning material such as water-resistant corrugated cardboard. As shown in the FIG. 2, the cartridge holder 200 is made in the shape of an opened cube large enough to enclose ink cartridge 100. The face 250 which the back of ink cartridge 100 contacts when cartridge holder 200 is assembled includes hole 202 through which protrusion 63 of the ink cartridge is to be loosely inserted. The face 251 which the top of ink cartridge 100 contacts includes an interior step 201 which pushes the ink cartridge downward after the case assembly is completed.

The surface which nozzle 4 of the ink cartridge contacts is provided with nozzle pressor 203. Although nozzle pressor 203 is made of a foamed material such as polyurethane foam or styrol resin form (styrofoam®) in this embodiment, flexible rubber can of course, also be used. Plastic film 204 is fastened to the surface of nozzle pressor 203 with a double-sided adhesive tape, for example. Note here surface of plastic film 204 is not coated with any adhesive agent.

The polyurethane foam constituting nozzle pressor 203 is adhered to the case such that it straddles the surface that contacts nozzle 4 of the ink cartridge and the surface that contacts terminal area 102 (shown in FIG. 7) on the bottom of the ink cartridge. When the case is assembled to pack the ink cartridge, nozzle 4 and terminal area 102 become covered by plastic film 204 adhered to the polyurethane foam. In this way, area 207 of the polyurethane foam also functions as a terminal pressor.

Figure 2:
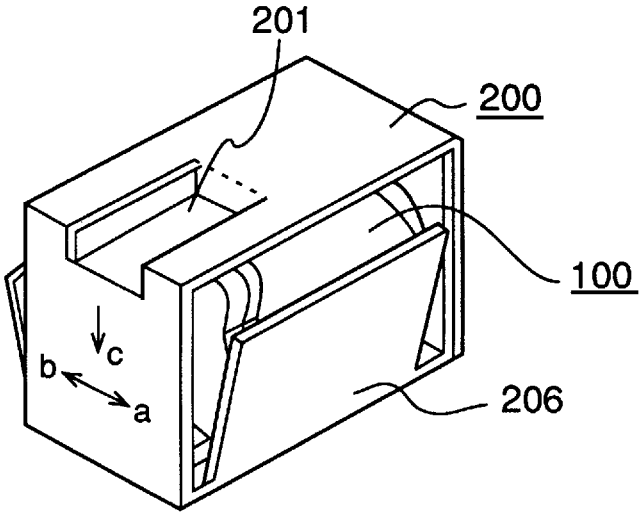
FIG. 2 is a perspective view of the case of FIG. 1 after assembly.

Ink cartridge 100 is placed on cartridge holder 200 thus configured as shown in FIG. 1, and then case 200 is bent along several bending areas 205 provided therein, to form the box shape shown in FIG. 2.

During this process, because protrusion 63 of the ink cartridge is inserted into hole 202 of the case, ink cartridge 100 will not shift in the direction of arrow a or b. Furthermore, because ink cartridge 100 is pressed in the direction of arrow c by step 201, terminal area 102 on the bottom of the cartridge is also pushed against plastic film 204 (terminal pressor 207) on the polyurethane foam. As a result, terminal area 102 is covered and protected by plastic film 204 on the soft polyurethane foam. Note here that, also shown in FIG. 2, nozzle 4 is merely touching plastic film 204, and is not completely sealed by nozzle pressor 203.

Figure 3:
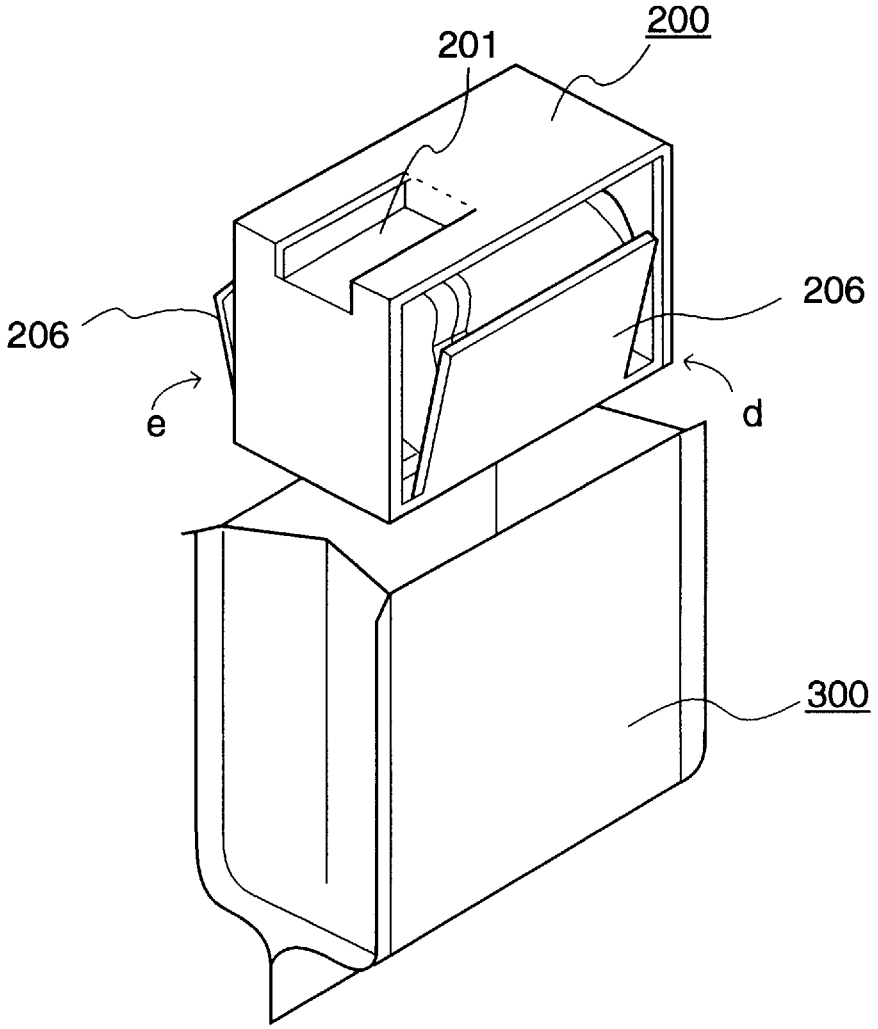
FIG. 3 is a perspective view of the case of FIG. 2 being inserted into the aluminum pack according to the preferred embodiment.
Figure 4:
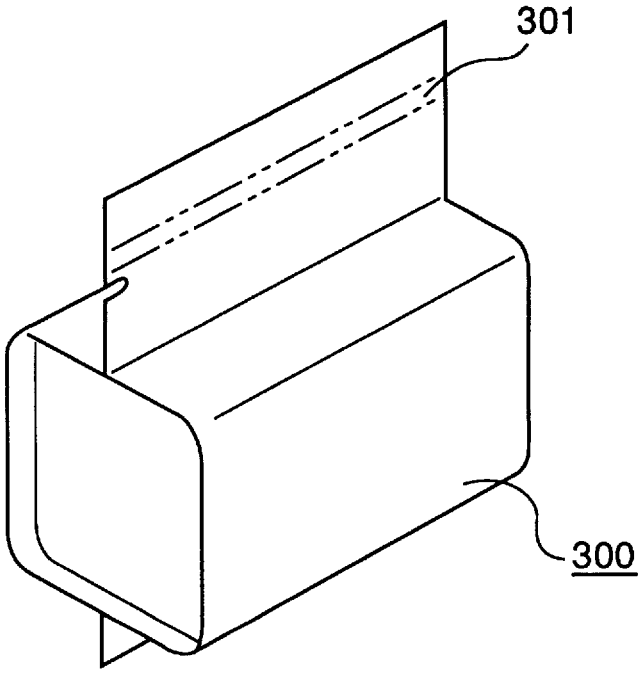
FIG. 4 is a perspective view of case and aluminum pack assembly of FIG. 3 after vacuum packing to form the ink cartridge package according to the first referred embodiment.

After ink cartridge 100 is placed inside cartridge holder 200 in this way, cartridge holder 200 containing ink cartridge 100 is placed inside aluminum pack 300 as shown in FIGS. 3 and 4.

Cartridge holder 200 is provided with protection flaps 206 (in two places) to ensure that the side of cartridge 100 will not touch aluminum pack 300 cartridge holder 200 which contains cartridge 100 and which is bent in the directions of arrows d and e is inserted into aluminum pack 300.

Figure 5:
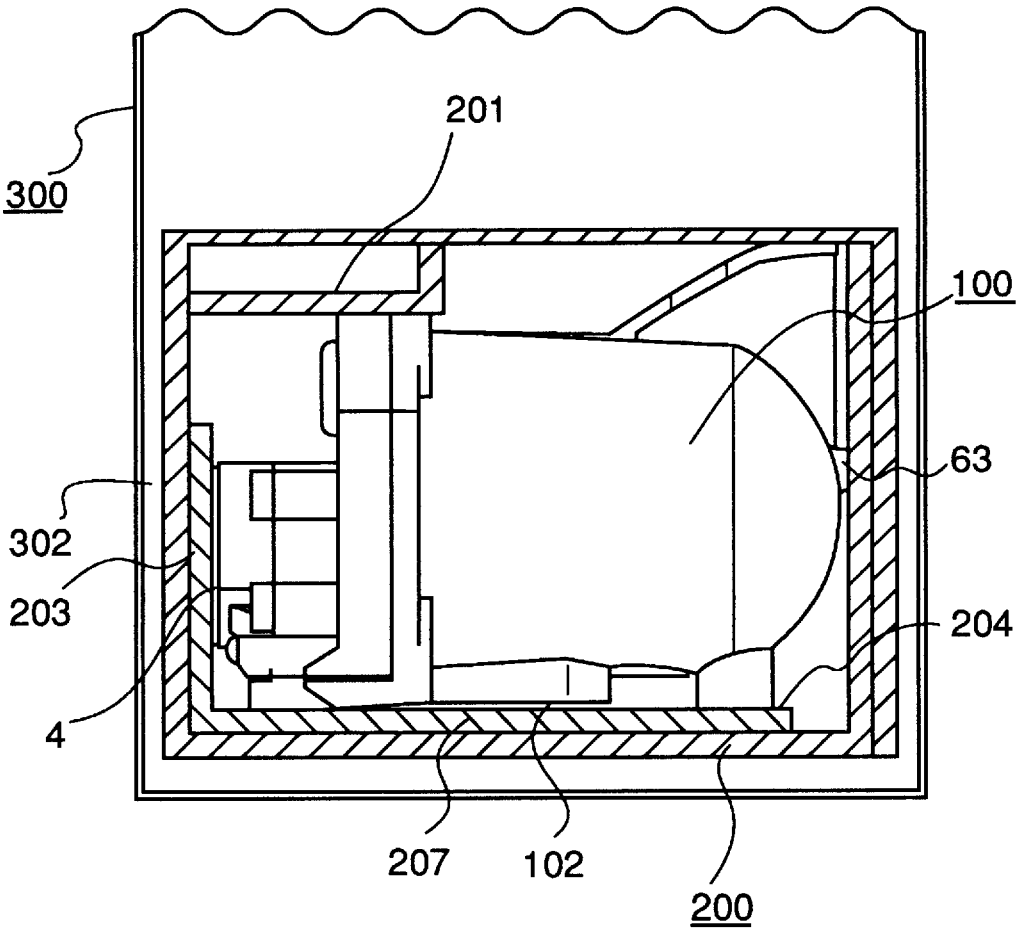
FIG. 5 is a cross-sectional view of the ink cartridge package of FIG. 4 prior to vacuum packing.

FIG. 5 is a cross-section showing the state in which cartridge holder 200 containing ink cartridge 100 is inserted into aluminum pack 300.

Aluminum pack 300 is shaped such that a gap 302 is formed between aluminum pack 300 and cartridge holder 200. In this state, aluminum pack 300 is set in a pressure-reduction or vacuum packing device. In this embodiment, the pressure inside aluminum pack 300 is reduced to 250 Torr. After the specified pressure reduction has been achieved, top area 301 of aluminum pack 300 is heat-welded as shown in FIG. 4, and then aluminum pack 300 is removed from the pressure-reduction device, completing the packing process.

Figure 6:
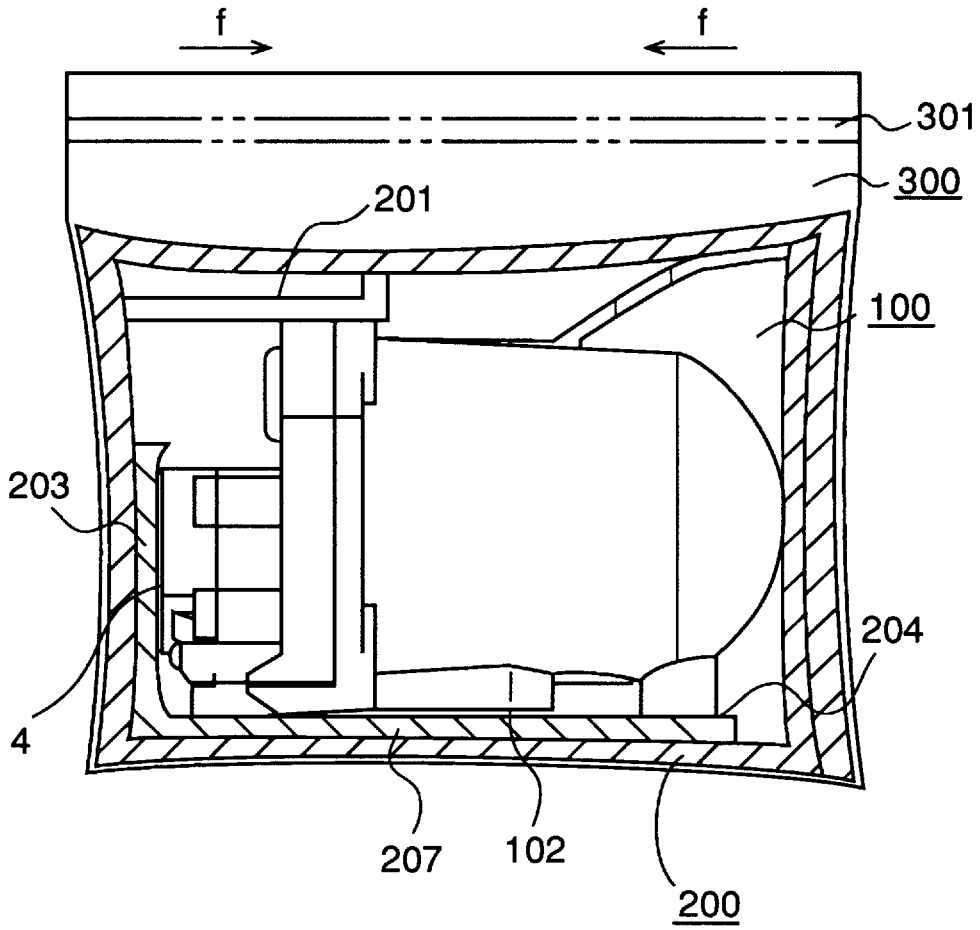
FIG. 6 is a cross-sectional view of the assembled ink cartridge package of FIG. 4 after vacuum packing.

In this state, no external air enters the package. By reducing the pressure inside aluminum pack 300, a pressure difference results between the interior and exterior of the aluminum pack, and the aluminum pack contracts as shown in FIG. 6. During this process, a pressing force is applied to cartridge holder 200 in the direction of arrow f as shown in FIG. 6, caused by the contraction of the aluminum pack 300 pushing nozzle pressor 203 against nozzle 4.

As a result, nozzle 4 becomes completely sealed by plastic film 204 and is isolated from the external atmosphere. Terminal area 102 on the bottom of the cartridge also tightly contacts plastic film 204.

Nozzle 4 and terminal area 102 are formed on different surfaces of the ink cartridge in this embodiment. Such a configuration is preferable in order to prevent ink from contaminating the terminal area should any ink leak out of the nozzle during the packaging process.

Figure 9:
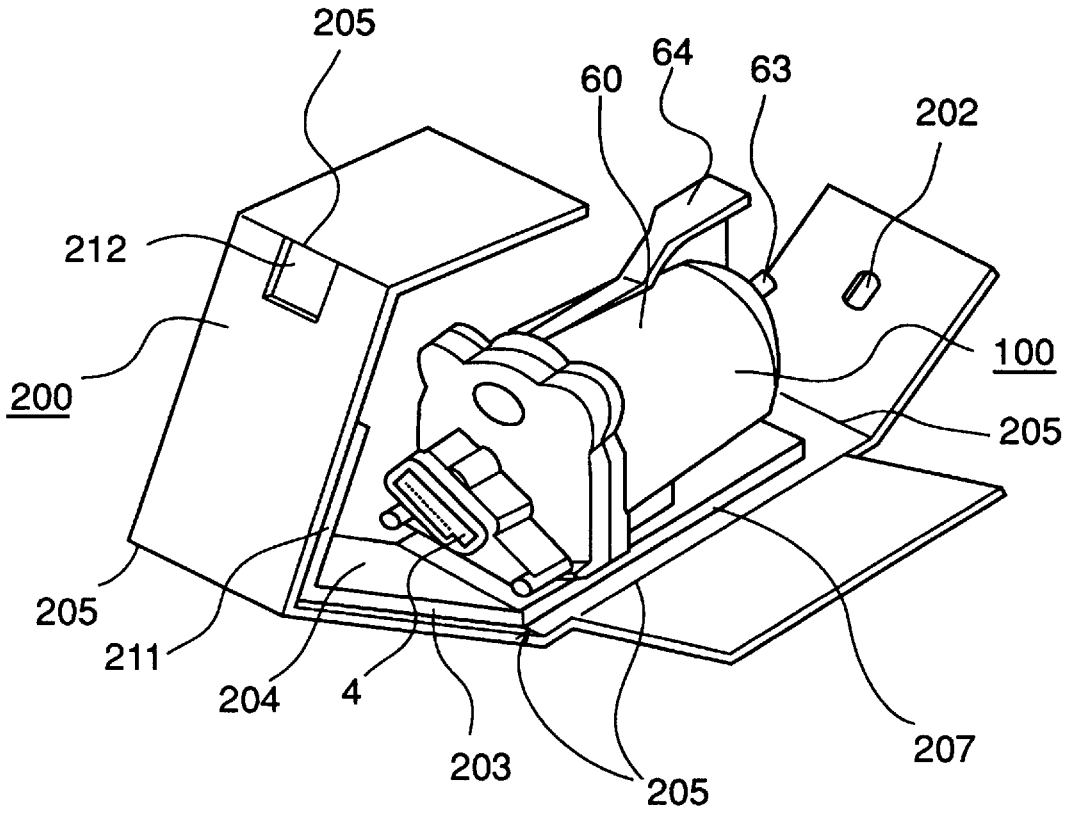
FIG. 9 is a perspective view of a partially disassembled internal case of the cartridge package according to a second preferred embodiment of the present invention including an ink cartridge.

FIG. 9 is a perspective view similar to that of FIG. 1 and showing ink cartridge 100 and a modified form of cartridge folder 200 for packaging the ink cartridge according to the second preferred embodiment. In the modified embodiment, instead of providing the step 201 in the top of cartridge folder 200 which contacts the top of ink cartridge 100, nozzle presser 203 is extended to that surface. The extended portion 211 forms a step having a function equivalent to step 201 in the embodiment of FIG. 1. Another difference between the embodiment of FIG. 1 and modification of FIG. 9 is that a hole 212 is provided in the top surface of internal case 200 so as to receive the uppermost part of a handle 64 provided on the upper back side of ink case 60. Handle 64 engaging hole 212 assists in holding ink cartridge 100 in place relative to cartridge holder 200.

The ink cartridge described above is merely a representative cartridge used to detail the presently preferred embodiments of the invention, and any ink cartridge in any form can be applied to the ink cartridge package of the invention as long as such an ink cartridge contains ink and possesses a nozzle for ejecting ink droplets.

While the invention has been described in conjunction with specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink cartridge package for housing an ink cartridge having an ink ejection area disposed on a surface thereof, the package comprising:

a cartridge holder for receiving and securing the ink cartridge, said cartridge holder comprising:

an interior surface adjacent the ink cartridge ejection area when said cartridge holder receives the ink cartridge; and a flexible, compressible nozzle pressing component disposed on said interior surface in communication with the ink cartridge ejection area when the cartridge holder secures the ink cartridge; and a bag housing circumscribing said cartridge holder and sealed under a pressure less than an ambient air pressure, wherein said bag housing constricts said cartridge holder by a force of said pressure, and said cartridge holder is deformable by the force of said pressure so as to compress the ink cartridge ejection area against said flexible, compressible nozzle pressing component to prevent ink seepage therefrom.

2. The ink cartridge package of claim 1, further comprising a non-absorbing layer disposed on said nozzle pressing component contacting the ink cartridge ejection area.

3. The ink cartridge of claim 2, wherein said non-absorbing layer comprises an ink impermeable plastic film.

4. The ink cartridge package of claim 1, wherein said cartridge holder comprises an impact cushioning material.

5. The ink cartridge package of claim 1, wherein said bag housing comprises an aluminum pack.

6. An ink cartridge package for housing an ink cartridge having separate ink ejection area and terminal area disposed thereon, the package comprising:

a cartridge holder for receiving and securing the ink cartridge, said cartridge holder comprising:

an interior surface adjacent the ink cartridge ejection area and terminal area when said cartridge holder receives the ink cartridge;

a flexible, compressible nozzle pressing component disposed on said interior surface in communication with the ink cartridge ejection area when the cartridge holder secures the ink cartridge; and a terminal pressing component disposed on said interior surface in communication with the ink cartridge terminal area secures the ink cartridge; and a bag housing circumscribing said cartridge holder and sealed under a pressure less than an ambient air pressure, wherein said bag housing constricts said cartridge holder by a force of said pressure, and said cartridge holder is deformable by the force of said pressure so as to compress the ink cartridge ejection area against said flexible, compressible nozzle pressing component to prevent ink seepage therefrom.

7. The ink cartridge package of claim 6, wherein said terminal pressing component and said nozzle pressing component are formed as a single unit.

8. The ink cartridge package of claim 6, wherein said terminal pressing component is disposed on a first portion of said interior surface and said nozzle pressing component disposed on a second portion of said interior surface adjoining said first portion of said interior surface of said cartridge holder.

9. The ink cartridge package of claim 7, wherein said terminal pressing component is disposed on a first portion of said interior surface and said nozzle pressing component disposed on a second portion of said interior surface adjoining said first portion of said interior surface of said cartridge holder.

10. The ink cartridge package of claim 6, further comprising a non-absorbing layer disposed on said nozzle pressing component contacting the ink cartridge ejection area.

11. The ink cartridge package of claim 10, wherein said non-absorbing layer comprises an ink-impermeable plastic film.

12. The ink cartridge package of claim 6, wherein said cartridge holder comprises an impact cushioning material.

13. The ink cartridge package of claim 6, wherein said bag housing comprises an aluminum pack.

14. A method for packaging an ink cartridge having an ejection area thereon, comprising the steps of:

providing a cartridge holder including an internal nozzle compressing component disposed hereon;

mounting the ink cartridge in said cartridge holder;

positioning at least one of the ink cartridge and the cartridge holder such that the cartridge holder nozzle compressing component engages the ink cartridge ejection area;

providing a circumscribing bag housing;

placing both the ink cartridge holder and said ink cartridge inside said circumscribing bag housing; and sealing the bag housing under a pressure less than an ambient air pressure thereby sealing the ink cartridge ejection area with the nozzle pressing component to prevent ink seepage therefrom, simultaneously with packaging the ink cartridge to the bag housing.

* * * * *